US005881827A

United States Patent [19]

Ikeda et al.

[11] Patent Number: 5,881,827

[45] Date of Patent: Mar. 16, 1999

[54] EXTENDABLE BIT

[75] Inventors: Nobuhisa Ikeda, Yokohama; Hiroyuki Kawasaki, Hachiouji; Taro Watanabe, Tokyo, all of Japan

[73] Assignee: Tone Corporation, Tokyo, Japan

[21] Appl. No.: 800,182

[22] Filed: Feb. 13, 1997

[30] Foreign Application Priority Data

Feb. 13, 1996 [JP] Japan ..... 8-000516
May 13, 1996 [JP] Japan ..... 8-117360

[51] Int. Cl.[6] ..... E21B 10/38

[52] U.S. Cl. ..... 175/259; 175/261; 175/265; 175/305

[58] Field of Search ..... 175/246, 257–262, 175/265, 305

[56] References Cited

U.S. PATENT DOCUMENTS

| | | | |
|---|---|---|---|
| 3,933,209 | 1/1976 | Sweeney | 175/257 |
| 3,990,524 | 11/1976 | Sweeney | 175/246 |
| 4,002,213 | 1/1977 | Sweeney | 175/58 |

FOREIGN PATENT DOCUMENTS

| | | |
|---|---|---|
| 0 204 677 | 12/1986 | European Pat. Off. . |
| 56-24758 | 6/1981 | Japan . |
| 61-164386 | 10/1986 | Japan . |
| 973790 | 10/1964 | United Kingdom . |
| 2 132 252 | 7/1984 | United Kingdom . |
| 2 275 067 | 8/1994 | United Kingdom . |

*Primary Examiner*—Roger Schoeppel
*Attorney, Agent, or Firm*—Sixbey, Friedman, Leedom & Ferguson; David S. Safran

[57] ABSTRACT

Extendable bit teeth are supported by the guide grooves formed on the end face at the point of a bit body in such a manner as to be slidable. The extendable bit teeth slide along the guide grooves in an excavating direction to thereby project from the end face at the point of the bit body. The extendable bit teeth slide in an opposite direction to the excavating direction to project from the outer periphery of the point of the bit body. Since the extendable bit teeth are pressed against the ground during excavation, the extendable bit teeth projects from the outer periphery of the point of the bit body so that the bit gauge can be extended, and most of the excavation hole is excavated by the bit body.

4 Claims, 6 Drawing Sheets

10
38
28
26
34
24
24
20
30
36
40a
32
22a
4
4
52
52
42
42a
44
22

10
38
28
26
24
24
20
30
32
42
40a
40
22b
22
22a
52
52
44
47
46
50
48
22

EXTENDABLE BIT

BACKGROUND OF THE INVENTION

1. Field of the Invention

The present invention relates generally to an extendable bit, and more particularly to an extendable bit used in a method in which an air hammer excavates the ground with a casing pipe, preventing the collapse of geological strata.

2. Description of the Related Art

Japanese Patent Publication No. 56-24758 discloses an extendable bit used in the above-mentioned excavation method.

This extendable bit consists of a bit body and bit teeth provided at the point of the bit body. The bit teeth are formed to have substantially the same diameter as the bit body, and the bit teeth are supported by guide grooves formed on a slope at the point of the bit so that the bit teeth can be slidable. A position regulating member regulates the upper and lower positions of the bit teeth. When the bit teeth are pressed against the bottom of an excavation hole, they slide along the guide grooves diagonally upward so that they can be extended. If the bit body rotates in such a state, the bit teeth rotate about an axis of the bit body, and thereby a larger diameter hole than the bit body can be excavated.

The above-mentioned conventional extendable bit, however, has an disadvantage of being weak because there are formed a number of notches such as guide grooves at the center of the bit body.

The conventional extendable bit has another disadvantage in that the excavation cannot be efficiently performed and a large amount of energy must be used in order to perform the task.

SUMMARY OF THE INVENTION

The present invention has been developed under the above-described circumstances, and has its object the provision of an extendable bit which can realize efficient excavation without using a large amount of energy.

In order to achieve the above-mentioned object, the present invention comprises: an air hammer operated by supplied air; a bit body provided at the point of the air hammer; a plurality of extendable bit teeth provided at the point of the bit body in such a manner as to be extendable and retractable from an axis of the bit body along a radius, wherein the extendable bit teeth are inclined on an end face of the point of the bit body by a predetermined angle with regard to the axis of the bit body, and the inclined faces of the extendable bit teeth are provided in guide grooves formed away from the axis of the bit body, and the extendable bit teeth are extended to project to the outside of the bit body when the bit body is pressed against the bottom of a hole, and the bit body and the extendable bit teeth perform excavation, and the extendable bit teeth are retracted to the inside of the bit body when the bit body is moved away from the bottom of the hole.

According to the present invention, the bit body excavates most of the excavation area during the excavation, and the extendable bit excavates only the large diameter part. That is, since most of the excavation area is excavated by the bit body, which is directly hit by a hammer piston, the excavation can be efficiently performed without using a large amount of energy, compared with the conventional extendable bit.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
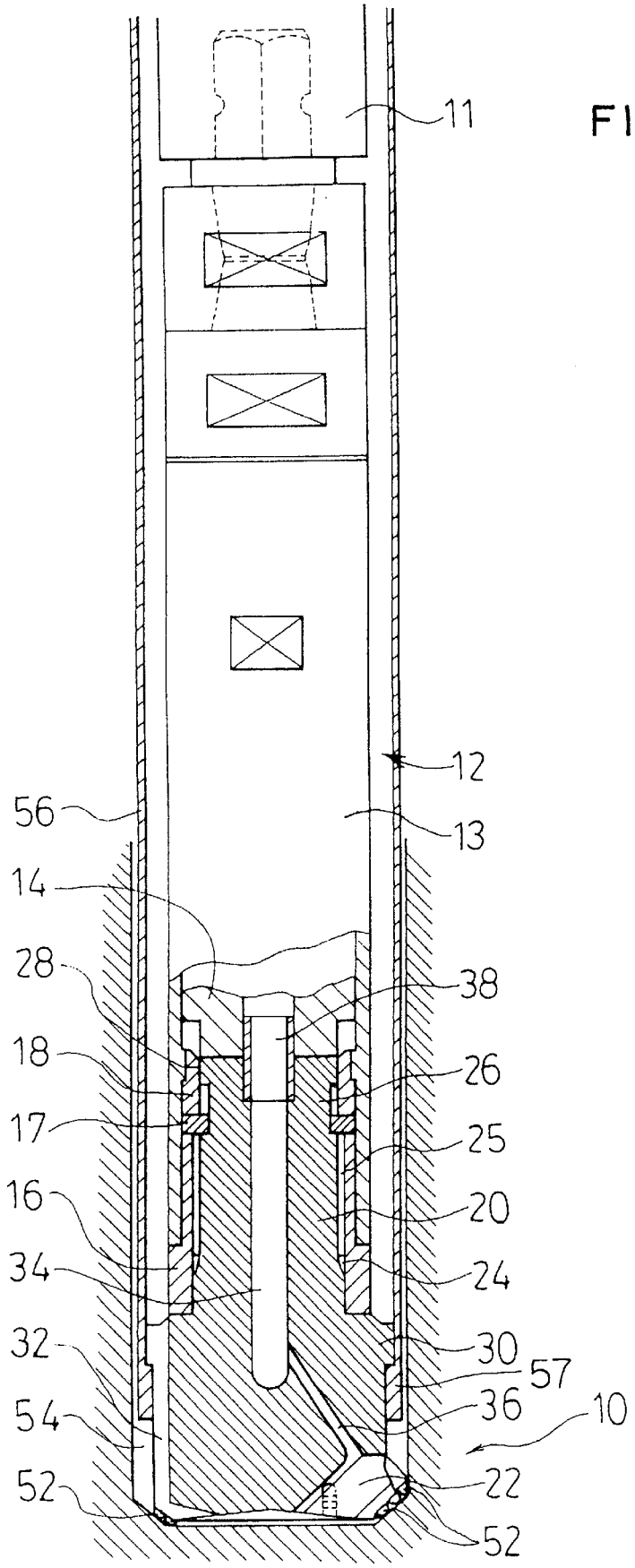
FIG. 1 is a side sectional view illustrating the side of an excavator using an extendable bit of the present invention.

FIG. 1 is a side sectional view illustrating an excavator using an extendable bit of the present invention. As shown in FIG. 1, the extendable bit 10 is mounted on a bottom of a cylindrical air hammer 12. A hammer piston 14 is built in a hammer cylinder 12, and the air hammer 12 rotates on an axis by rotational power (not shown). A female screw is formed on an inner wall at the bottom end of the hammer cylinder 13, and a guide 16 is engaged with the female screw. Splines 25, 25, . . . are formed within the hollow guide 16, and the splines 25, 25, . . . are engaged with splines (male) 24, 24, . . . which are formed at a bit body 20. The guide 16 is engaged with the female screw via a ring 17 and a collar 18, and the ring 17 supports the body 20 with a flange 28 formed at the bit body 20.

Figure 3:
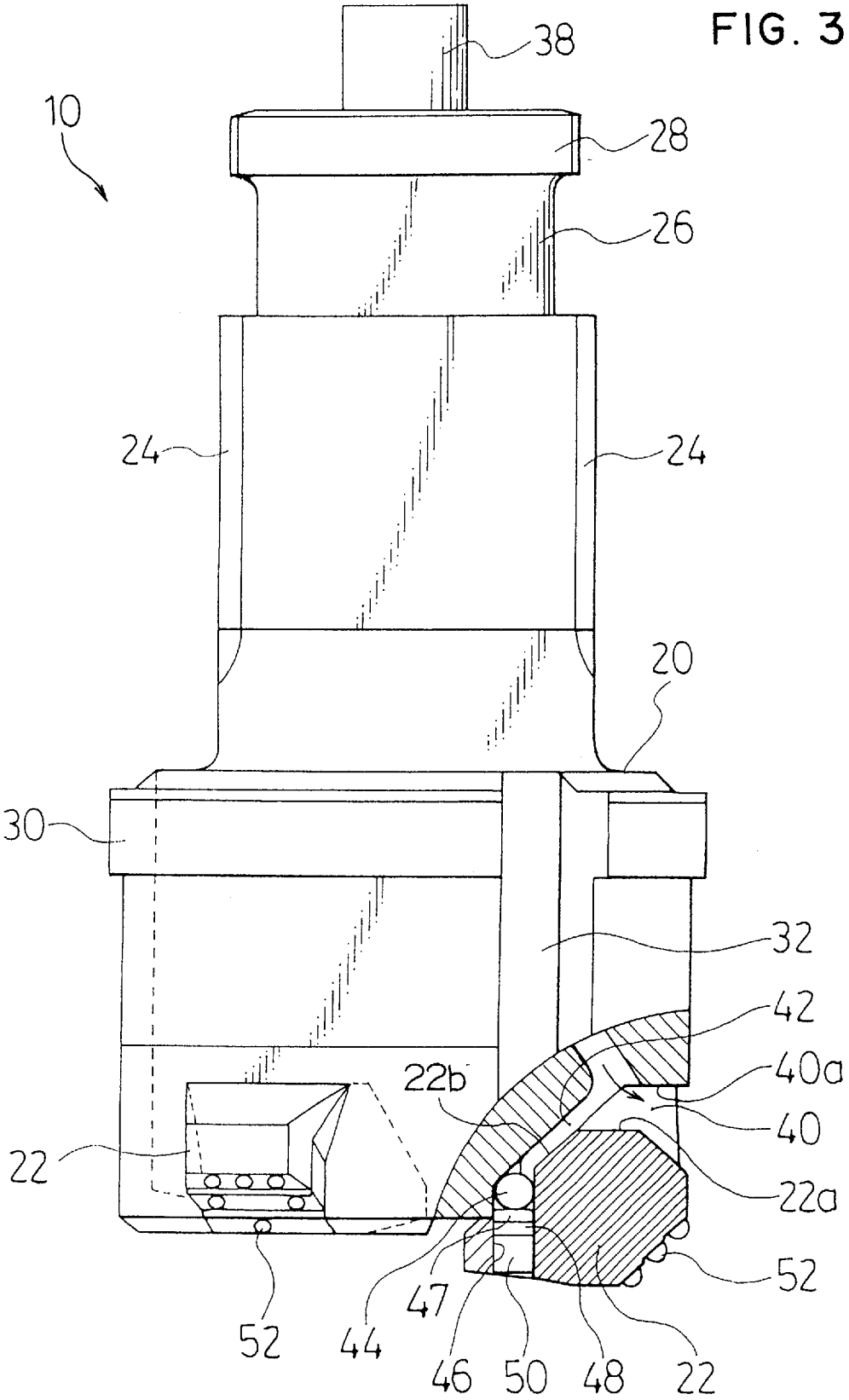
FIG. 3 is a partially side sectional view of an embodiment for an extendable bit according to the present invention (in a retracted state)
Figure 4:
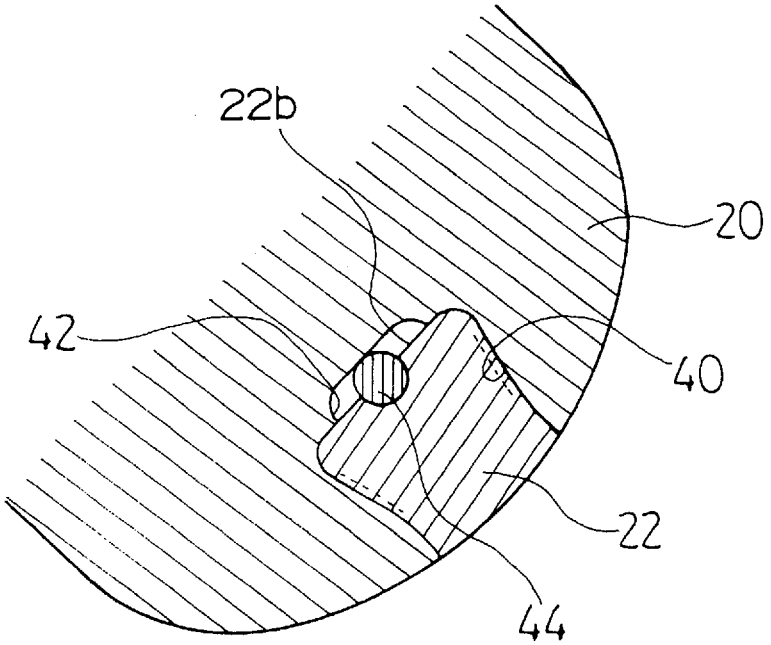
FIG. 4 is a sectional view taken along line 4—4 of FIG. 2.
Figure 5:
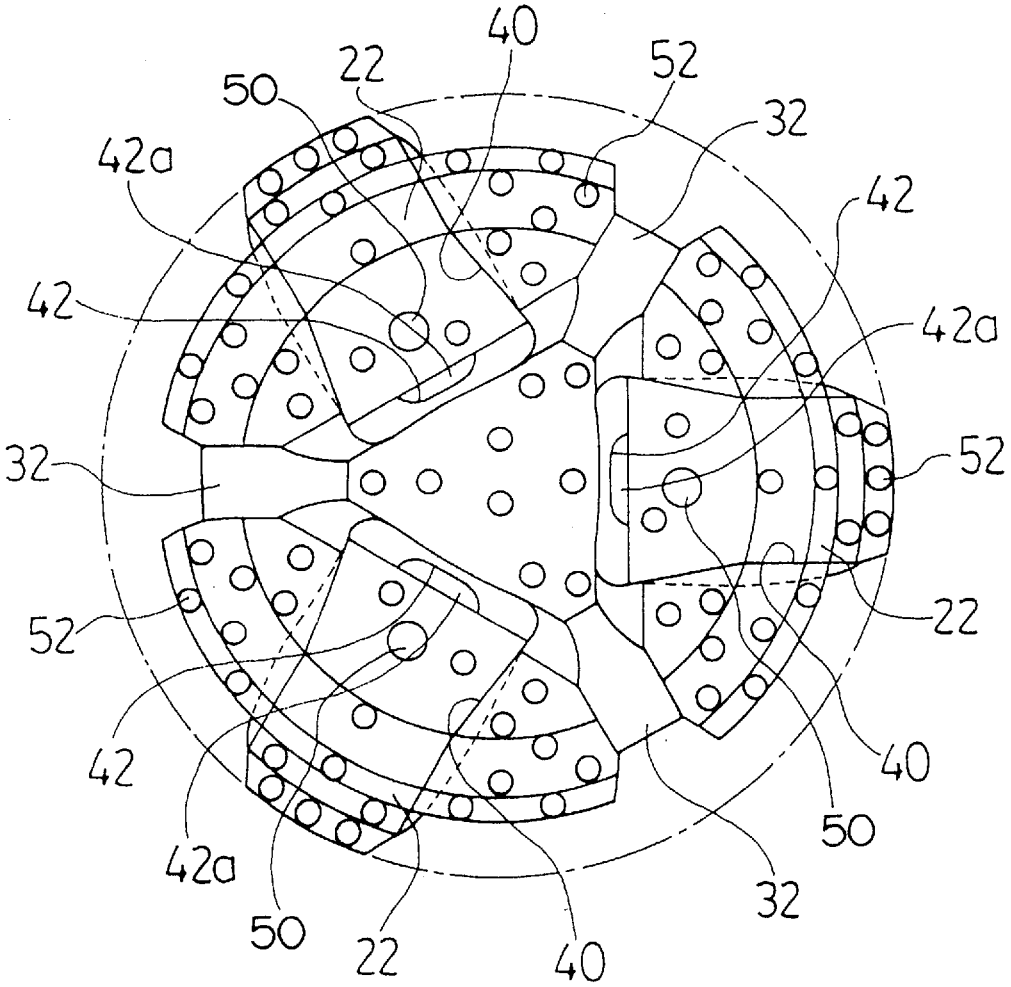
FIG. 5 is a bottom view illustrating an embodiment for an extendable bit according to the present invention.
Figure 6:
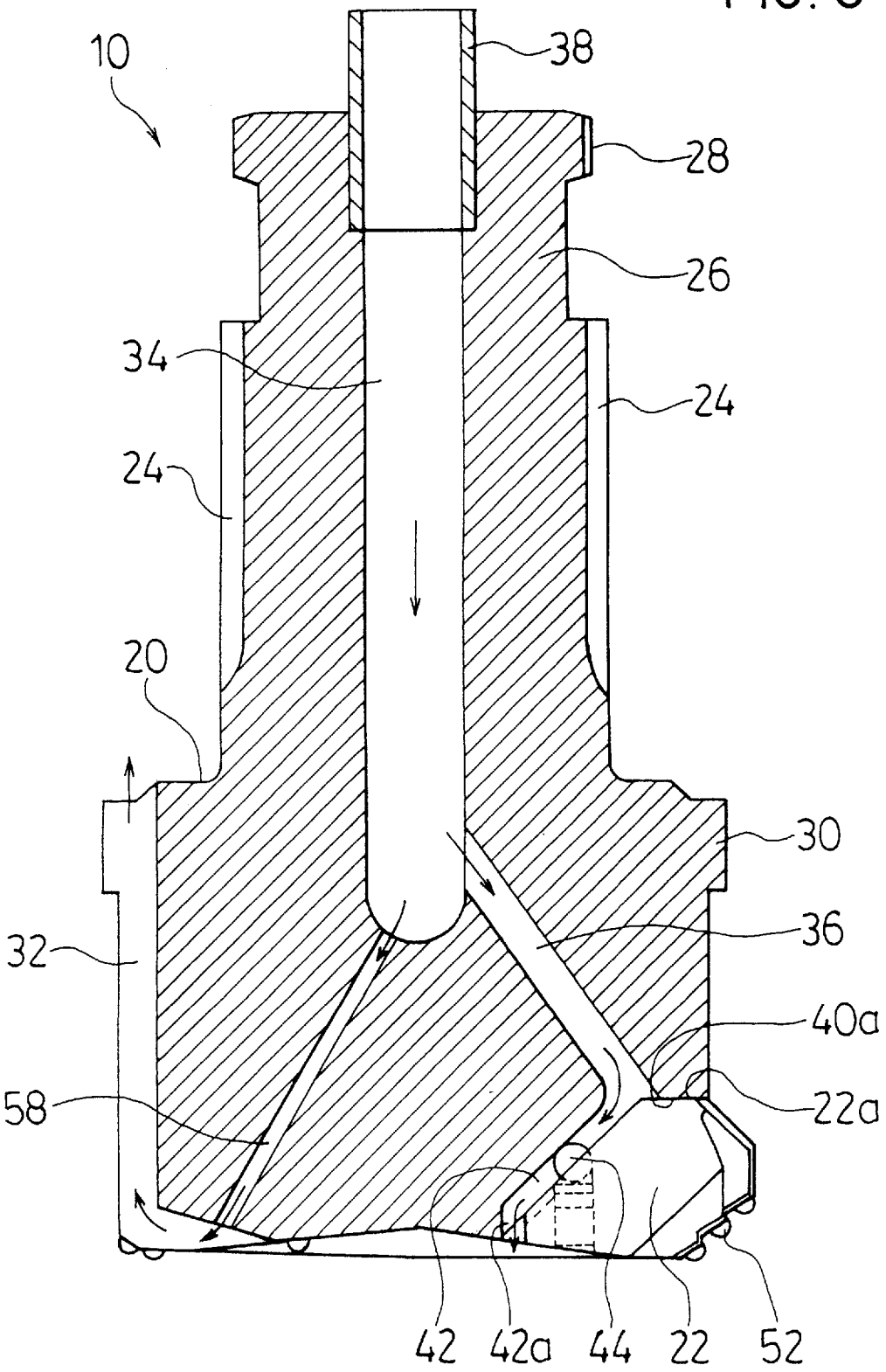
FIG. 6 is a side sectional view illustrating another embodiment for an extendable bit according to the present invention.

As depicted in FIGS. 3, 4 and 5, the extendable bit 10 consists of a bit body 20 and three extendable bit teeth 22, 22, 22 which are radially arranged at the point of the bit body 20. In FIG. 3, the sectional extendable bit tooth 22 at the right side is in a retracted state. The extending bit tooth 22 at the left side, which is indicated by a solid line, is in an extended state. The splines 24, 24, . . . are formed at the bit body 20, and a columnar part 26 is formed at the top of the splines 24, 24, . . . . The flange 28 is formed at the top end of the columnar part 26.

A large diameter part 30 is formed substantially at the center of the bit body 20. When the bit body 20 is inserted into a casing pipe 56 from above, the large diameter part 30 comes into contact with a bit receiving face (a receiving part) 57 which is formed to project from the inner periphery of the point of the casing pipe 56. Thus, the large diameter part 30 hits the bit receiving face 57 during excavation, and the casing pipe 56 as well as the bit body 20 excavates the ground.

Exhaust grooves 32, 32 and 32 are provided at the outer periphery of the bit body 20, and the exhaust grooves allow for the removal of the excavated sediment.

An exhaust passage 34 is formed at the inside of the bit body 20, and the exhaust passage 34 exhaust air used for operating the hammer piston 14. The exhaust passage 34 communicates with guide grooves 40 formed on the end face of the point of the bit body 20 via branch passages 36. The air used for operating the hammer piston 14 is exhausted to above the ground from the guide grooves 40 via an excavation hole 54. Reference numeral 28 at the top end of the exhaust passage 34 indicates a valve for operating the hammer piston 14.

The hammer piston 14 hits the top of the bit body 20, so that the bit body 20 can slide up and down. When the bit body 20 falls, the ring 17 supports the flange 28 so as to prevent the bit body 20 from falling out. Since the spline (male) 24 is engaged with the spline (female) 25 formed within the guide 16, the bit body 20 and the air hammer 12 can rotate unitedly.

Figure 2:
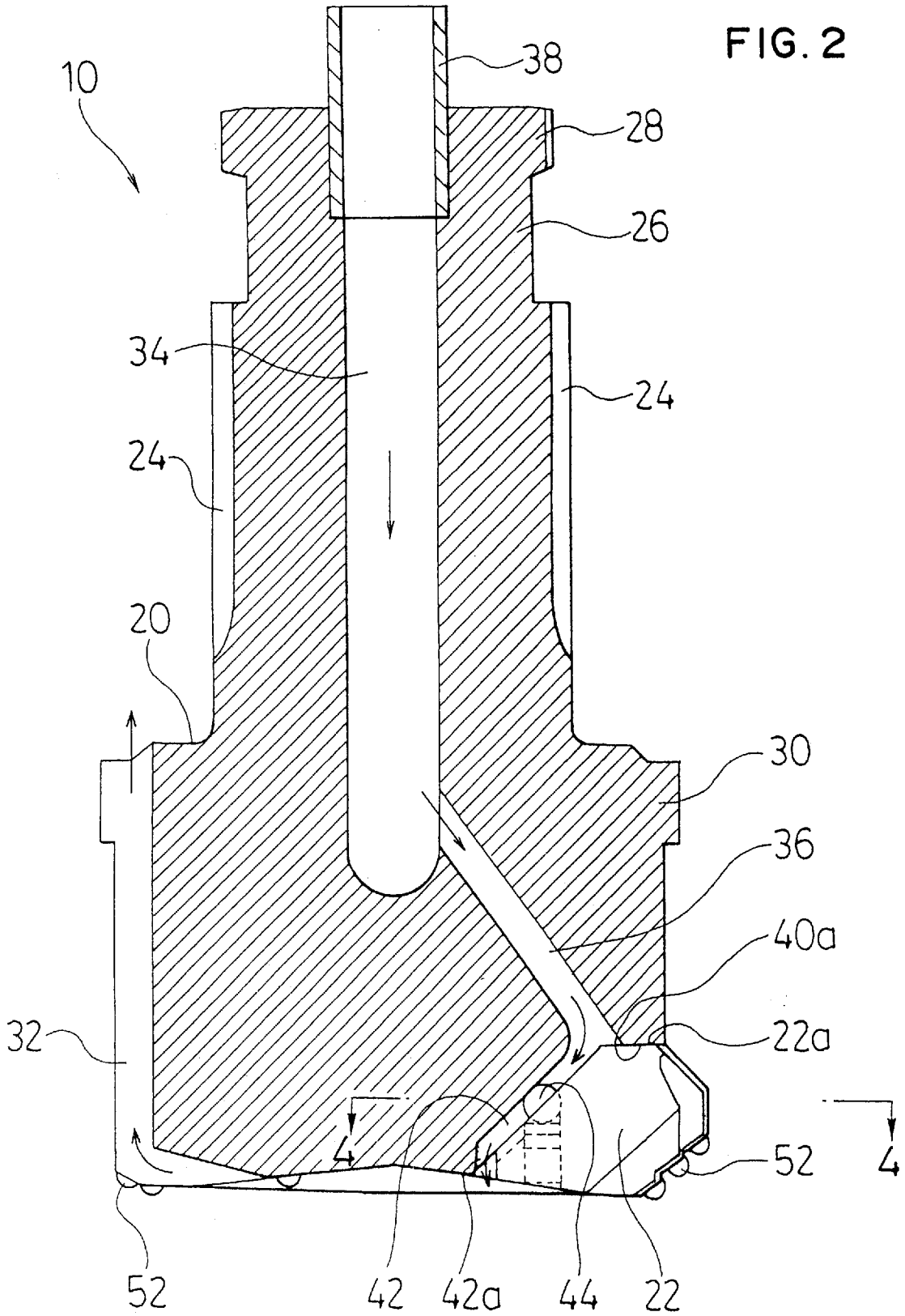
FIG. 2 is a side sectional view illustrating an embodiment for an extendable bit according to the present invention (in an extended state)

On the other hand, as depicted in FIGS. 2, 3 and 5, the three extendable bit teeth 22 are supported by three guide grooves 40 which are radially formed on the end face of the point of the bit body 20 in such a manner as to be slidable. The guide grooves 40 are inclined by a predetermined angle with regard to the axis of the bit body 20, and each extendable bit teeth 22 slide diagonally, guided by the guide grooves 40.

The side of the guide groove 40 is tapered as depicted in FIG. 4, and the side of the extendable bit tooth 22 is also tapered accordingly. Thus, even if the guide grooves 40 are inclined, the extendable bit teeth 22 do not come out from the guide grooves 40.

There is a stopper groove 42 of a predetermined length formed along the guide groove 40. A steel ball as a bit anchoring member is movably coupled to the stopper groove 42. The steel ball 44 is provided in such a manner as to project from the inclined face at the top of the extendable bit tooth 22. The steel ball 44 rolls at the inside of the stopper groove 42 in connection with the slide of the stopper groove 42. The steel ball 44 comes into contact with the bottom end of the stopper groove 42, so that the downward movement of the extendable bit teeth 22 can be regulated.

On the other hand, when the extendable bit teeth 22 move up, a top end 22*a* thereof comes into contact with a top end 40*a* of the guide groove 40. Thereby, the upward movement of the extendable bit teeth 22 is regulated.

After the extendable bit teeth are mounted in the guide grooves 40, the steel ball 44 is attached to the extendable bit teeth 22 in the following manner. First, the steel ball 44 is inserted into an attachment hole 46 punched in the extendable bit teeth 22, and then a plate 47 and a pin 50 (a fixing member) are pressed into the attachment hole 46 via a rubber plate 48. Consequently, the steel ball 44 projects from the slope at the top of the extendable bit teeth 22, and then the steel ball 44 is coupled to the stopper groove 42.

When the extendable bit teeth 22 mounted on the bit body 20 slide along the guide grooves 40 in an opposite direction to the drilling direction, the outer periphery of the extendable bit teeth 22 projects from the outer periphery of the point of the bit body 20 as shown in FIG. 2. In this case, the end face of the point of the bit body 20 is substantially flush with the end face of the point of the bit body 20. On the other hand, when the extendable bit teeth 22 slide in the excavating direction (downward direction in FIG. 2), the end face of the point of the extendable bit teeth 22 projects from the end face of the point of the bit body 20. The outer periphery of the extendable bit teeth 22 is substantially flush with the outer periphery of the point of the bit body 20.

When the extendable bit 10 is on the ground, the force is applied to the extendable bit teeth 22 upwardly from the ground. The extendable bit teeth 22 are extended in such a manner that the outer periphery thereof projects from the outer periphery of the bit body 20. On the other hand, when the extendable bit 10 is off the ground, the extendable bit teeth 22 moves down due to the deadweight thereof, and the bit gauge is retracted in the direction of the inner diameter.

As stated previously, each guide groove 40 communicates with the exhaust passage 34, and the air used for operating the air hammer 14 is exhausted from the guide groove 40 to the excavation hole. In this case, when the extendable bit teeth 22 are extended, the air is exhausted from the stopper groove 42 into the excavation hole 54 via a gap 42*a* which is formed at the point of the stopper groove 42. On the other hand, when the extendable bit teeth 22 are retracted, the air is exhausted into the excavation hole 54 via a gap between the top end 40*a* of the guide groove 40 and the top end 22*a* of the extendable bit teeth 22. Thereby, the air is always jetted to the guide grooves 40, so that the excavated sediment, etc. can be prevented from stopping up the guide grooves 40 and the stopper groove 42. Thus, the extendable bit teeth 22 can always slide smoothly.

The bit body 20 and the extendable bit teeth 22, 22, 22 are constructed in the above-mentioned manner. As depicted in FIG. 5, the sufficient number of metal tips 52, 52, . . . made of cemented carbide are fixed to the end face of the point of the bit body 20 and the extendable bit teeth 22.

An explanation will hereunder be given about the operation of an embodiment for the excavator using the extendable bit of the present invention which is constructed in the above-mentioned manner.

The air hammer 12 to which the extendable bit 10 is attached is suspended by an excavation pipe 11, and the air hammer 12 is inserted into the casing pipe 56. Because the extendable bit teeth 22 are retracted to have a smaller diameter than the inner diameter of the casing pipe 56, so that the extendable bit teeth 22 can be inserted into the casing pipe 56.

Next, the extendable bit 10 inserted into the casing pipe 56 is landed on the ground. Since the extendable bit teeth 22 on the ground receive the force upward from the ground, the extendable bit teeth 22 slide upward. Thus, as shown in FIGS. 1 and 2, the outer periphery of the extendable bit teeth 20 projects from the outer periphery of the tip of the bit body 20, and thereby the diameter of the casing pipe 56 is larger than the outer diameter of the casing pipe 56. In this case, the end face of the point of the extendable bit teeth 22 is flush with the end face of the point of the bit body 20.

The excavation starts in this state. That is, a driving apparatus (not shown) feeds and rotates the excavation pipe 11, and sends the air into the excavation pipe 11. The air is supplied to the air hammer 12, and the hammer piston is actuated to generate the hitting force.

The extendable bit 10 rotates in connection with the rotation of the air hammer 12. At the same time, when the hammer piston built in the hammer cylinder 13 hits the top of the extendable bit 10, the extendable bit 10 advances into the ground, and the excavation hole 54 is excavated by the metal chips 52, 52, . . . . In this case, the bit body 20 excavates most of the excavation hole, and the extendable bit teeth 22 excavate the large diameter part corresponding to the thickness of the casing pipe 56. Thus, the excavation can be efficiently performed.

Simultaneously with the excavation, the bit receiving face 57 of the casing pipe 56 is hit by the large diameter part 30, and the casing pipe 56 is put down into the ground as the extendable bit 10 moves downward.

The excavated sediment, etc. are removed by the air jetted from the guide grooves 40, and the sediment as well the exhaust air are discharged to above the ground through the casing pipe 56 via an exhaust groove 32 which is formed in the bit body 20.

As stated previously, the air is jetted to the guide grooves 40 and the stopper groove 42, thereby preventing the excavated sediment from stopping up the guide grooves 40 and the stopper groove 42, and also preventing the malfunction of the guide grooves 40 and the stopper groove 42.

After the excavation is complete, the extendable bit 10 is pulled out from the casing pipe 56. In order to retract the extendable bit teeth 22 in an extended state, the extendable bit 10 is pulled up. That is, when the extendable bit 10 is pulled up, the extendable bit teeth 22 are retracted by their deadweight. Further, when the extendable bit 10 is pulled up, the extendable bit teeth 22 come into contact with the periphery of the bottom end of the casing pipe 56. Thus, the extendable bit teeth 22 slide downward, being pushed toward the periphery of the lower end of the casing pipe 56, so that the extendable bit teeth 22 are retracted. Thereby, the extendable bit is pulled out from the casing pipe pipe 56 to be collected. The casing pipe 56, which is buried in the excavation hole 54, can prevent the excavation hole 54 from collapsing.

As stated above, according to the extendable bit of this embodiment, the bit body 20, which is directly hit by the air hammer 12, excavates most of the excavation area, and the extendable bit teeth 22 excavate only the large diameter part. Thus, compared with the conventional extendable bit, the excavation hole 54 can be efficiently excavated without wasting much energy. Thereby, the extendable bit 10 of the present invention is applicable to the large diameter bit.

Because the guide grooves 40 are formed at the periphery of the bit body 20, there is no problem about the strength of the bit body 20.

If the extendable bit teeth 22 have been worn down, each one can be separately replaced by a new one, so that it can be very economical. Since each extendable bit teeth 22 is small in size, the manufacturing cost can be reduced. The extendable bit teeth 22 can be easily removed from the guide grooves only if ut the steel ball 44 is taken out.

Furthermore, the air used for operating the air hammer 12 is exhausted from the guide groove 40 so that the extendable bit teeth 22 can always slide smoothly. Thereby, the extendable bit teeth 22 can be retracted smoothly. When there is enough air, a branch passage 58 may be formed which exhaust a part of the exhaust air from the point of the bit body 20 to the bottom of the bit body.

In this embodiment, as shown in FIGS. 2 and 5, the bottom of the extendable bit teeth 22 in the extended state is substantially flush with the bottom of the bit body 20. If the bottom of the extendable bit teeth 22 is not flush with the bottom of the bit body 20, the metal chips 52, 52, . . . of the extendable bit teeth 22 are not flush with the metal chips 52, 52, . . . of the bit body 20, and all the metal chips 52, 52, . . . cannot be effectively used. For example, if the bottom of the extendable bit teeth 22 is located behind the bit body 20, the metal chip 52 of the extendable bit tooth 22 located within the bit body 20 does not perform the excavation. As stated previously, because the bottom of the extendable bit teeth 22 is flush with the bottom of the bit body 20, all the metal chips 52, 52, . . . can be effectively used. For this reason, the excavation can be efficiently performed in this embodiment.

Moreover, the extendable bit 10 performs the excavation, followed by the casing pipe 56 in this embodiment. The extendable bit 10 of this embodiment, however, can also be used when the excavation diameter is enlarged during the excavation. In this case, a normal bit excavates the area until it reaches the large diameter part. When reaching the large diameter part, the normal bit is replaced by the extendable bit 10 of the present invention, which excavates the large diameter part.

As set forth hereinabove, according to the present invention, the bit body excavates most of the excavation area, and the extendable bit teeth excavates only the large diameter part. For this reason, the extendable bit of the present invention can efficiently perform the excavation without using a large amount of energy.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. An extendable bit comprising:

an air hammer operated by air supplied;

a bit body provided at a tip of said air hammer in such a manner as to be slidable; and a plurality of extendable bit teeth provided at a point of said bit body in such a manner as to be extendable and retractable from an axis of said bit body along a radius, wherein said extendable bit teeth are inclined on an end face of the point of said bit body by a predetermined angle with regard to the axis of said bit body, the inclined face of said extendable bit teeth being provided in guide grooves formed away from the axis of said body such that said extendable bit teeth are slidable, and said extendable bit teeth being extended when said bit body is pressed against the bottom of an excavation hole, and said bit body and said extendable bit teeth perform excavation, and said extendable bit teeth being retracted to inside of said bit body when said bit body is moved away from the bottom of said excavation hole; wherein exhaust air used for operating said air hammer passes through said bit body, and is exhausted from said guide grooves and the bottom of said bit body into said excavation hole during excavation.

2. The extendable bit as defined in claim 1, wherein a bit anchoring member attachment hole is formed at said extendable bit teeth, said bit anchoring member being inserted into said attachment hole, one end of said bit anchoring member being coupled to a stopper groove, formed at said bit body, by a fixing member pressed into said attachment hole.

3. The extendable bit as defined in claim 1, wherein a bottom of said extendable bit teeth in an extended state is substantially flush with a bottom of said bit body.

4. The extendable bit as defined in claim 1, wherein said extendable bit is insertable into a casing pipe when said extendable bit teeth are retracted; wherein the casing pipe has an inwardly projecting bit receiving face formed therein at an end of the casing pipe; wherein the bit body has a large diameter part, said large diameter part coming into contact with said bit receiving face of said casing pipe during excavation.

* * * * *